US012209498B2

(12) United States Patent
Khorshidi et al.

(10) Patent No.: US 12,209,498 B2
(45) Date of Patent: Jan. 28, 2025

(54) SYSTEM AND METHOD FOR SIMULTANEOUS EXCAVATION AND SEGMENT ERECTION OF TBM BY THRUST SHELL

(71) Applicants: TopEng Inc., Oakville (CA); Jamal Rostami engineering Services LLC, Arvada, CO (US)

(72) Inventors: Behzad Khorshidi, Oakville (CA); Jamal Rostami, Arvada, CO (US)

( * ) Notice: Subject to any disclaimer, the term of this patent is extended or adjusted under 35 U.S.C. 154(b) by 436 days.

(21) Appl. No.: 17/404,938

(22) PCT Filed: Feb. 18, 2020

(86) PCT No.: PCT/US2020/018695
§ 371 (c)(1),
(2) Date: Aug. 17, 2021

(87) PCT Pub. No.: WO2020/172195
PCT Pub. Date: Aug. 27, 2020

(65) Prior Publication Data

US 2023/0332504 A1 Oct. 19, 2023

Related U.S. Application Data

(60) Provisional application No. 62/808,741, filed on Feb. 21, 2019.

(51) Int. Cl.
*E21D 9/06* (2006.01)
*E21D 11/08* (2006.01)

(52) U.S. Cl.
CPC ..... *E21D 9/0607* (2013.01); *E21D 11/08* (2013.01)

(58) Field of Classification Search
CPC ..... E21D 9/06; E21D 9/0635; E21D 9/0607; E21D 9/0609; E21D 9/093; E21D 9/0873; E21D 9/0879; E21D 11/00; E21D 11/08; E21D 11/18; E21D 11/40
See application file for complete search history.

(56) References Cited

U.S. PATENT DOCUMENTS 2,128,172 A * 8/1938 Warner ..... E21D 11/07 405/141
2,610,470 A * 9/1952 White ..... E21D 11/40 405/150.1
2,756,036 A * 7/1956 McIntyre ..... E21B 7/003 299/56
3,022,562 A * 2/1962 Card ..... E21D 11/102 425/468

(Continued)

*Primary Examiner* — Benjamin F Fiorello

(57) ABSTRACT

A system and method for simultaneous excavation and segment erection of Tunnel Boring Machine (TBM) by Thrust shell system is an invention in tunnelling industry which will provide possibility of erection of the segmental ring while TBM is excavating and advancing forward with minimum interruption which will result in significantly increasing of the tunneling speed. The increased speed of the tunnelling will be reducing cost of the construction expressively.

At this system and method, the TBM thrust cylinders will be pushing against previously installed segmental ring via combination of a thrust shell and an expandable ring while a new segmental ring is being built by TBM's segment erector within the Thrust shell's provided inner space.

9 Claims, 12 Drawing Sheets

(56) References Cited

U.S. PATENT DOCUMENTS

| | | | | | |
|---|---|---|---|---|---|
| 3,600,899 | A * | 8/1971 | Watson | E21D 9/04 | 405/141 |
| 4,147,453 | A * | 4/1979 | Unger | E21D 9/0692 | 405/141 |
| 4,152,027 | A * | 5/1979 | Fujimoto | E21D 9/04 | 405/141 |
| 4,302,133 | A * | 11/1981 | Althaler | E21D 11/18 | 405/290 |
| 4,311,344 | A * | 1/1982 | Akesaka | E21D 9/0879 | 299/33 |
| 4,451,176 | A * | 5/1984 | Flocke | E21D 9/06 | 405/150.2 |
| 4,557,627 | A * | 12/1985 | Schmid | E21D 9/0635 | 405/145 |
| 4,558,906 | A * | 12/1985 | Takamiya | E21D 9/0879 | 299/56 |
| 4,911,578 | A * | 3/1990 | Babendererde | E21D 9/0635 | 405/146 |
| 5,101,608 | A * | 4/1992 | Ewers | E04G 21/1866 | 52/749.15 |
| 5,203,614 | A * | 4/1993 | Robbins | E21D 9/06 | 299/56 |
| 6,092,963 | A * | 7/2000 | Miya | E21D 9/0635 | 405/141 |
| 7,040,712 | B2 * | 5/2006 | Sakae | E21D 9/0879 | 405/141 |
| 2002/0189138 | A1 * | 12/2002 | Yoshimoto | E21D 9/0873 | 37/242 |
| 2015/0308268 | A1 * | 10/2015 | Okada | G01B 11/2408 | 701/50 |

* cited by examiner

Expanded Ring 110

Collapsed Ring 110

ZOOMED DETAIL OF HINGED CIRC. PLATES

SYSTEM AND METHOD FOR SIMULTANEOUS EXCAVATION AND SEGMENT ERECTION OF TBM BY THRUST SHELL

FIELD OF THE INVENTION

This invention generally relates to utilization of thrust shell and expandable ring for shield Tunnel Boring Machine (TBM) to be used mainly in the tunnel construction and its variations.

BACKGROUND OF THE INVENTION

In typical/conventional soft ground tunneling using a shield machine, forward movement is stopped for installation of the segmental lining. This means that the advance cycle is the sum of excavation and segment installation, which often take equal amount of time. In rock tunneling, use of double-shield TBMs are on the rise due to the advantages they offer, mainly one pass tunneling where the final lining is installed. Since the excavation and segment installation is simultaneous for double shield TBM, the advance cycle is determined by the longer of either excavation or segment erection process. Often in medium to soft rock conditions, segment erection takes more time, thus adding to the time requirement for each advance cycle. Meanwhile, when grippers of a Double shield TBM cannot operate, machine works by locking the front and tail shield and operates as in single shield, thus the work cycle of single shield and same timing issues apply.

At the proposed method in this invention all the aforementioned concerns are addressed. The utilization of Thrust shell system for TBM allows for segment erection while the machine continues to excavate with minimum interruption. This is expected to increase tunneling speed significantly, with the possibility to reach up to nearly twice the daily advance rates in certain settings at soft ground theoretically. The reduced construction period will expressively reduce the cost of the construction.

SUMMARY OF THE INVENTION

A system and method for simultaneous excavation and segment erection of TBM by Thrust shell system is an invention in tunnelling industry which will provide possibility of erection of the segmental ring while Tunnel Boring Machine (TBM) is excavating and advancing forward with minimum interruption which will result in significantly increasing the tunneling speed. The increased speed of the tunnelling will be reducing cost of the construction expressively. At this method, the TBM thrust cylinders will be pushing against previously installed segmental ring via combination of thrust shell and an expandable ring while a new segmental ring is being built by TBM's segment erector within the thrust shell's provided inner space.

DETAILED DESCRIPTION

Figure 1:
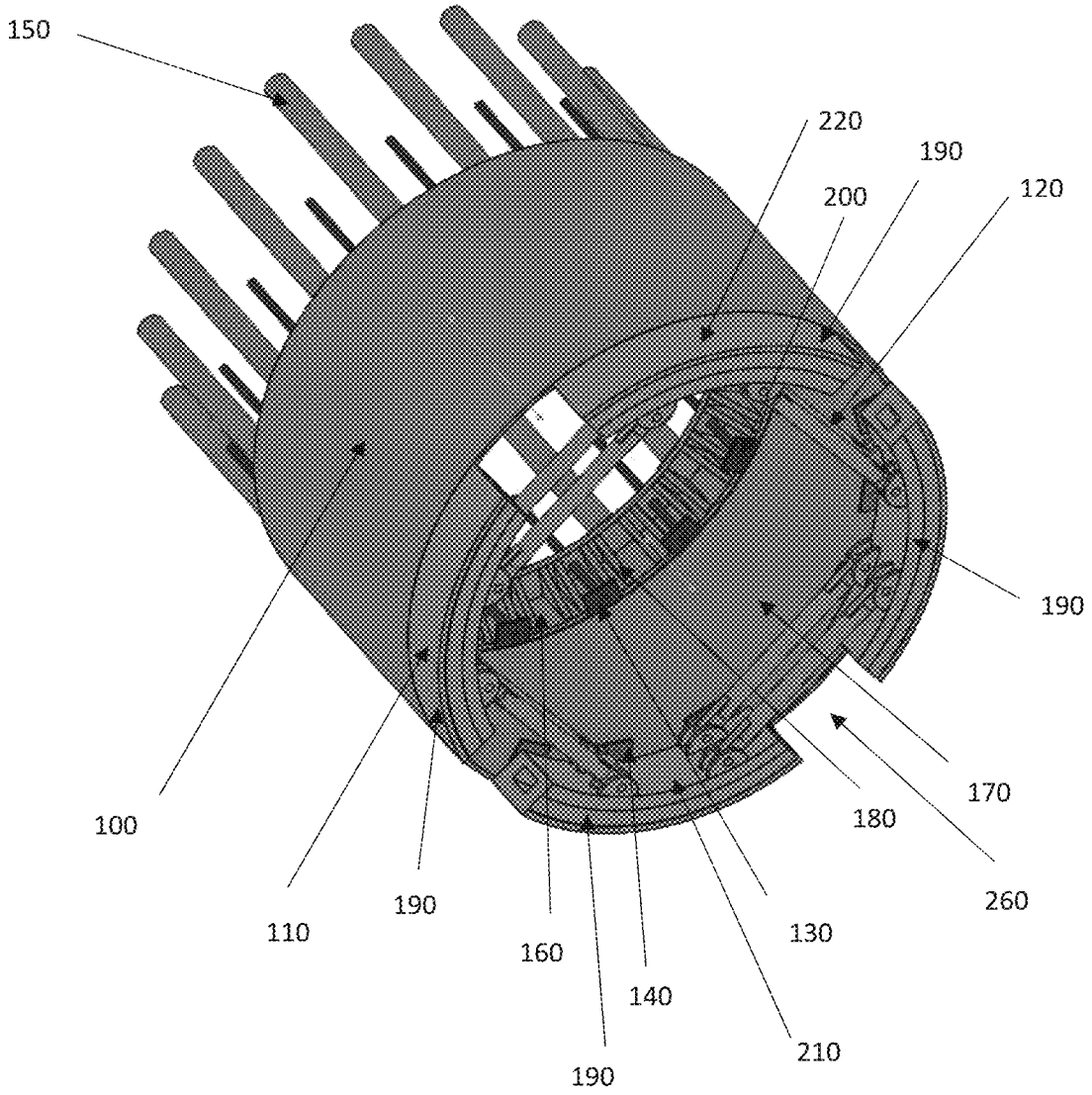
FIG. 1. 3D view of the Thrust shell and Expandable ring (looking from lining side)
Figure 2:
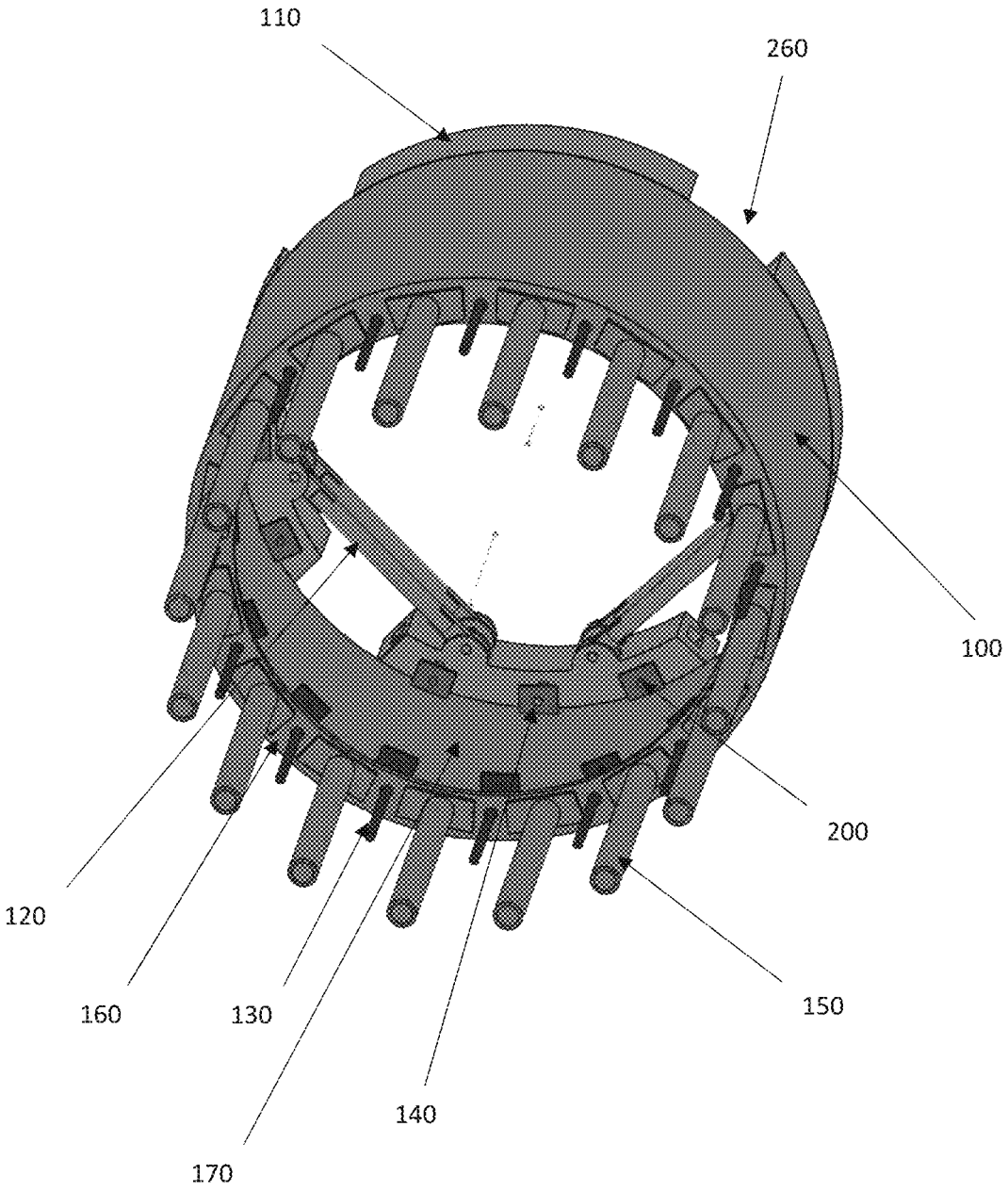
FIG. 2. 3D view of the Thrust shell and Expandable ring (looking from TBM side)

FIGS. 1 and 2 illustrate 3D views of a general thrust shell 100 comprising a main hallow can 170 and thrust ring 160 that is connected to thrust cylinders 150 of the TBM 310. So the movement (pushing/pulling) of the Thrust shell 100 will be controlled by TBM 310's thrust cylinders 150.

The thrust shell's ring may be comprising stiffeners 180 on the Thrust ring 160 if needed structurally. The thickness of the hallow can 170 of the Thrust shell 100 may be thicker at the thrust ring 160 area structurally. However, the extra thickness will be toward inside of the thrust ring 160.

The hallow can 170 will be able to move back and forth within the gap between TBM 310's trailing shield 312 and segmental rings 172/174. Therefore, ID of the thrust can 170 should be more than OD of the segmental ring 172/174, and OD of the thrust can 170 should be less than ID of the TBM 310's trailing shield 312.

An expandable Ring 110 will be positioned at front of the previously installed segmental ring 172 and lining. (See FIG. 8*a*) The main function of the Expandable ring 110 is to transfer pushing load from the TBM 310's thrust cylinders 150 and thrust shell 100 to the previously installed segmental ring 172. The expandable ring 110 is comprising a plurality (2, 3, 4, 5 or such) of sectors 190 (most likely with cross section of hollow square or hollow rectangular) with required stiffeners that are connected by circumferential cylinders/jacks 120. Therefore, the expandable ring 110 is able to be expanded or collapsed between two different diameters by extending or retracting of the circumferential cylinders 120.

The circumferential cylinders 120 can be either made by hydraulic piston or screw jack system or similar systems. At expanded mode, the OD of the expandable ring 110 is almost equal to OD of the thrust shell and ID of the expandable ring 110 is almost equal to ID of the segmental ring 172/174. At collapsed mode, the OD of the expandable ring 110 is less than ID of the segmental ring 172/174 to be able to move within the segmental rings 172/174.

While TBM 310 is pushing against the installed segmental ring 172 via thrust shell 100 and expanded expandable ring 110 and advancing forward by expanding TBM's thrust cylinders 150, a new segmental ring 174 will be built within inner space of the thrust shell's hallow can 170 space by TBM 310's segment erector 316. (See FIG. 8*b* and FIG. 8*c*).

The segments for the new segmental ring 174 will be contacted by jacks 130 and 140 in axial direction of the tunnel at segment's circumferential leading and trailing sides. The axial jacks 130 at the segment's circumferential leading side of the segment are mounted on the thrust ring 160 and the axial jacks 140 at the segment's circumferential trailing side of the segment are mounted on the expandable ring 110.

The axial jacks 130 and 140 may be made by hydraulic or screw-jack system or similar. Alternatively, the axial jacks 130 for the circumferential leading side of the segment may be mounted within the stationary shield 314 of the TBM 310, similar to TBM 310's thrust cylinders 150. In this case length of those axial jacks 130 will need to be longer.

Numbers of the axial mounted jacks 130 and 140 may be equal to nos. of the dowels at each face of the segmental ring 172/174. Depending on the design, numbers of the axial mounted jacks 130 and 140 will be equal but might be less (e.g. half) of the numbers of the dowels at each face of the segmental ring 172/174. The thrust shell 100's axial mounted jacks 130 and the expandable ring 110's axial mounted jacks 140 should be aligned with dowels locations at leading and trailing side of the segments.

Before starting segment erection for a new segmental ring 174 within the thrust can 170, all axial jacks 140 of the expandable ring 110 will be extended to their required position.

TBM 310's segment erector 316 will be erecting the new segmental ring 174 almost like the typical/conventional segmental lining. It will bring each segment to its position where expandable ring 110's axial jack(s) 140 will be contacted with the segment and segment erector 316 will be holding the segment till axial mounted jacks 130 on the thrust shell 100 will be extending and contacting with the segment and then the segment will be hold. The segment erector 316 will bring the next segments one by one for erection and to complete a full segmental ring 174. Connection method at radial sides of the segments in a ring (bolt, Post-tensioning strand, etc.) should be completed at this stage.

For better contact between segments and mounted axial cylinders, short struts 200 will be mounted to the shoes faces of the axial jacks 130 and 140 that will be entered in the segment's dowel holes during the segment erection. Thus, the erected segmental ring 174 will be stable and kept at circle shape and hence oval-shaping of the new segmental ring 174 can be avoided. Furthermore only if necessary, the segment erector 316 of the TBM 310 can temporarily hold the new segmental ring 174 from its inner side at the crown portion to help preventing the oval-shaping of the new ring till its installation to the previously installed ring 174.

As soon as the segmental ring 174 is completed within the thrust shell 100 (and also TBM 310 advancement cycle completed for one full segmental ring 174), then all axial jacks 140 of the expandable ring 110 will be retracted and subsequently all circumferential cylinders 120 of the expandable ring 110 will be retraced as well to collapse the expandable ring 110. (See FIG. 8*d*) Then Segment erector 316 will be lifting the expandable ring 110 from its upper side of lowest sector 210 and therefore space between previously installed segmental ring 172 and newly erected segmental ring 174 will be clear. (See FIG. 8*e*) The dowels between new segmental ring 174 and previously installed ring 172 may be installed at this stage.

Since ID of the expandable ring's all sectors 190/210 is equal to ID of the segments, the segment erector 316 can grab the upper side of the lowest segment 210 of the expandable ring 110, lift and move it almost like a segment. Alternatively, segment erector 316 can grab, lift and move the expandable ring 110 from its bottom side of upper sector 220 as well.

The segment erector 316 of the current conventional/typical TBM 310*s* may need some modifications for this operation to carry weight of the expandable ring 110 (which might be more than its capacity), also geometrically to adopt width of the lowest sector 210 (or upper sector 220) of expandable ring 110 which may have less width than concrete segment in most of the cases.

Further, lowest sector 210 (or upper sector 220) of the expandable ring 110 will be designed such a way that, their inner side can accommodate the segment erector 316 suitably. For instance, circumferential cylinders 120 connected to the mentioned sectors 210/220 can be spaced enough to have more room for the segment erector 316. Also connection points of circumferential cylinders 120 to those sectors 210/220 can be located within inside space of the sectors 210/220 (instead of their inner side) to provide more room for the segment erector 316.

The newly erected segmental ring will be pushed by axial mounted jacks 130 to its final position to contact and connect (by dowels) with the previously installed segmental lining, and thrust shell 100 will be pulled out by retracting TBM 310's thrust cylinders 150 to its new position. (See FIGS. 8*f* and 8*g*).

Then segment erector 316 will bring the expandable ring 110 to its new position at leading side of the last ring and afterward circumferential cylinders 120 will be extended to expand the expandable ring 110. Then thrust shell 100 will be pushed to contact with the expandable ring 110 and start pushing TBM 310 forward and concurrently another new segmental ring 174 erection will be commenced within the can 170. (See FIGS. 8*g* and 8*h*).

The only downtime/stoppage of the excavation and segment erection can be assumed to be almost equal to time needed for one segment erection by segment erector 316 since segment erector 316 will be lifting the collapsed expandable ring 110 and will move that to its new position, almost similar to one segment installation required time. As example it would be estimated that for a tunnel lining with 6 segments per segmental ring, speed of the tunnelling may be increased around $(6-1)/6\times100=83.3\%$ theoretically. I.e. speed of the tunnelling would be increased around 1.83 times theoretically.

Current conventional/typical TBM 310's trailing shield 312 will need to be longer (around 1.5 times of the segmental ring 172/174 width longer) to accommodate the thrust shell 100 and expandable ring 110. E.g. if segment width is 1.2 m, then length of TBM 310 would be around 1.80 m longer.

In most of the cases it won't be necessary to increase TBM 310's diameter to accommodate the thrust shell 100 system as existing gap between TBM 310's trailing shield 312 and segmental lining 174 would be enough for operation of the thrust shell 100. However only if needed, diameter of the current conventional/typical TBM 310 might be necessary to slightly increase.

Figure 3:
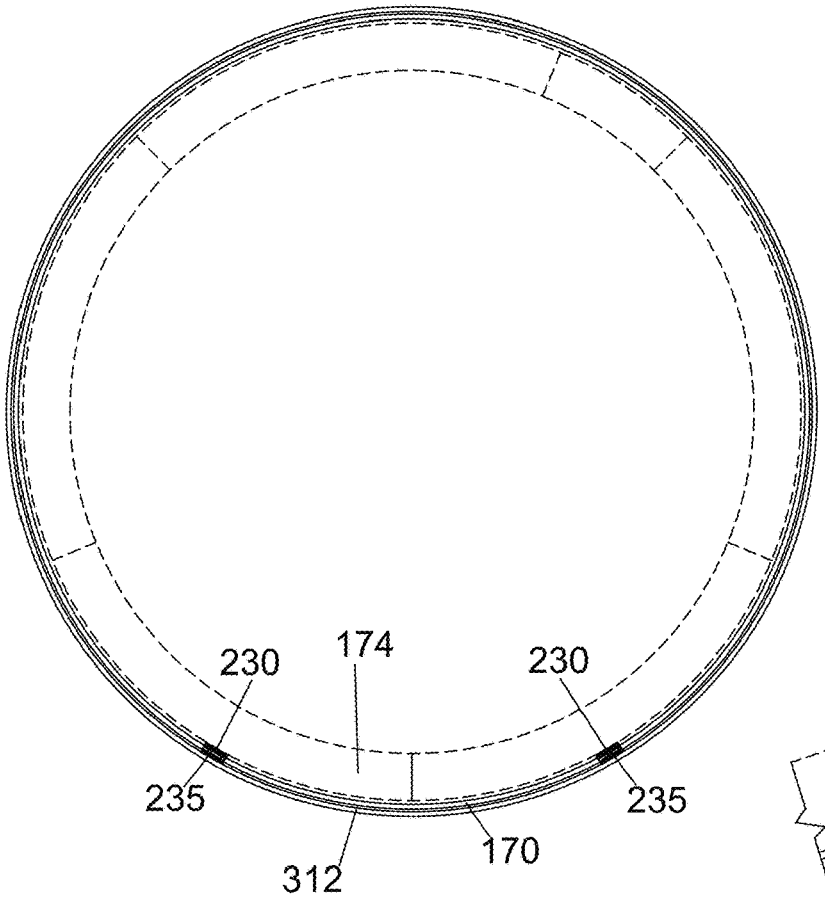
FIG. 3. Option for utilization of strip rollers to reduce frictions
Figure 3A:
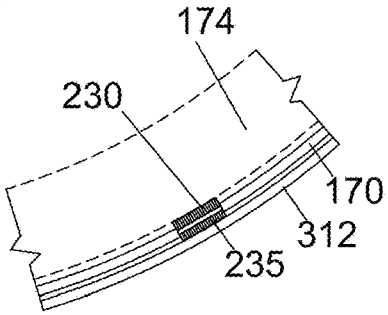
FIG. 3*a*. Zoomed detail of using strip roller concept

As self-weight of the thrust shell 100 as well as self-weight of the newly erected segmental ring 174 within the thrust shell 100 will push the thrust shell 100 down to trailing shield 312, optionally in order to reduce relevant frictions between thrust shell 100 and new segmental ring 174, and also friction between thrust shell 100 and TBM 310's trailing shield 312, plurality of strip rollers 230/235 may be connected at least at bottom part of the thrust shell 100 within the hollow can 170. As shown at FIGS. 3 and 3*a* example, two groups of strip rollers may be utilized including inner strip rollers 230 and outer strip rollers 235. Top side of the inner strip rollers 230 are in contact with surface of the new segmental ring 174 and bottom side of the outer strip roller 235 are sitting on the trailing shield 312. Optionally such strip rollers 230/235 may be used at all around the can 170 to reduce friction at all perimeter. Generally single rollers may be used instead of strip rollers 230/235 as well.

Figure 8A:
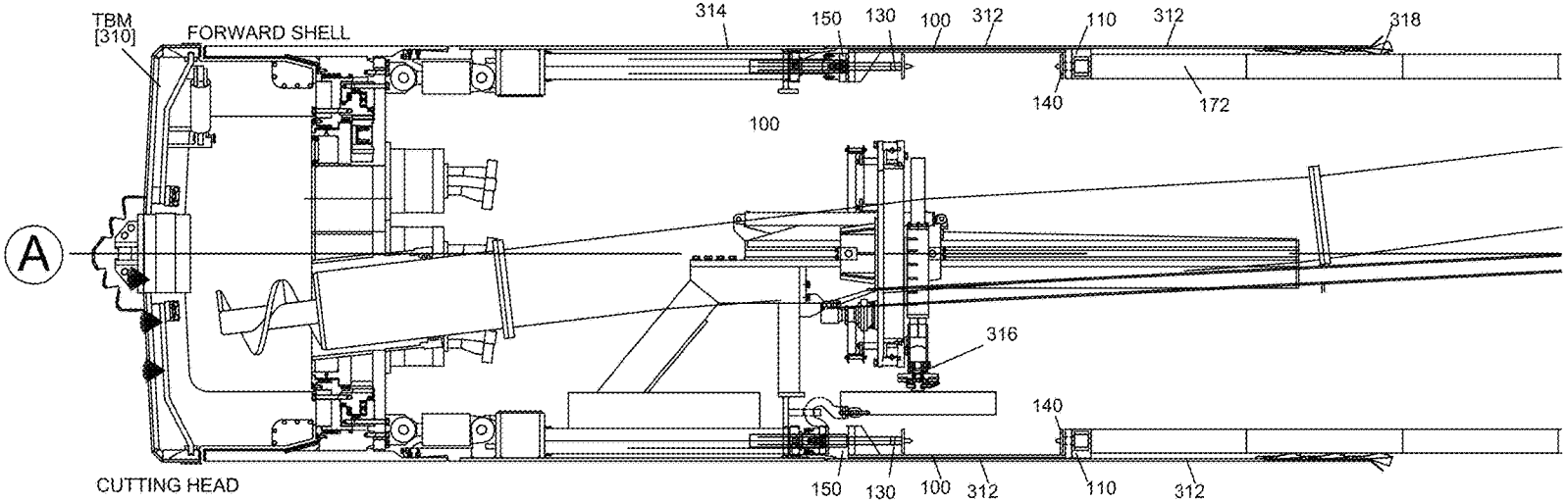
FIG. 8*a*. Stage A.
Figure 8B:
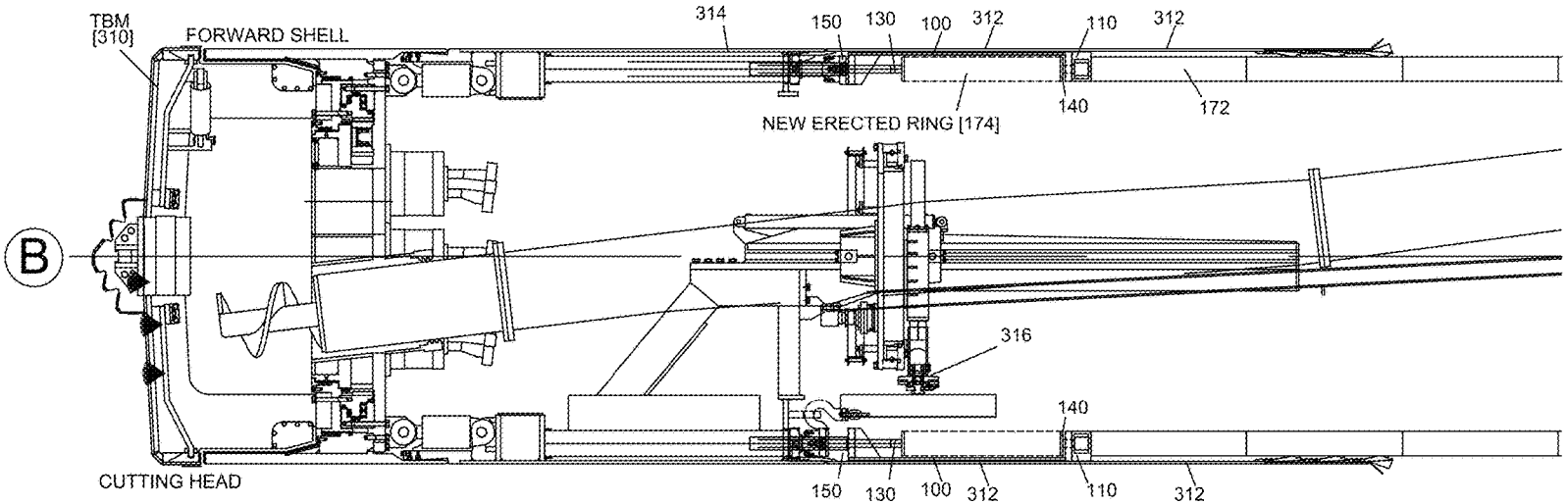
FIG. 8*b*. Stage B.
Figure 8C:
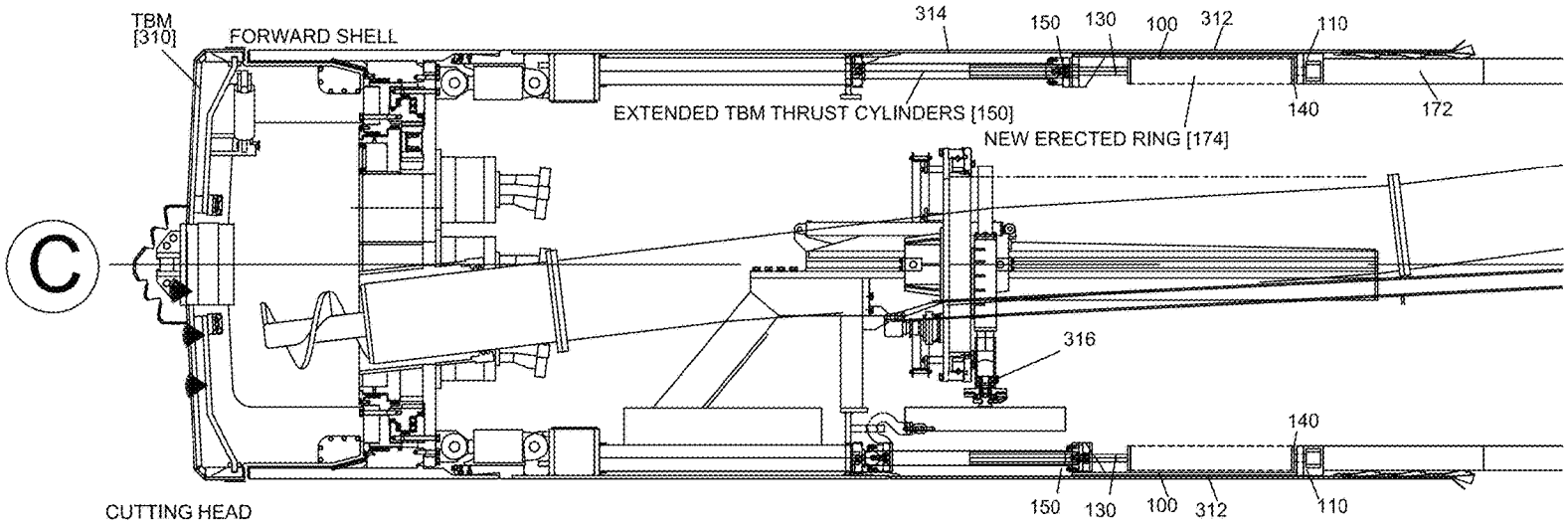
FIG. 8*c*. Stage C.
Figure 8D:
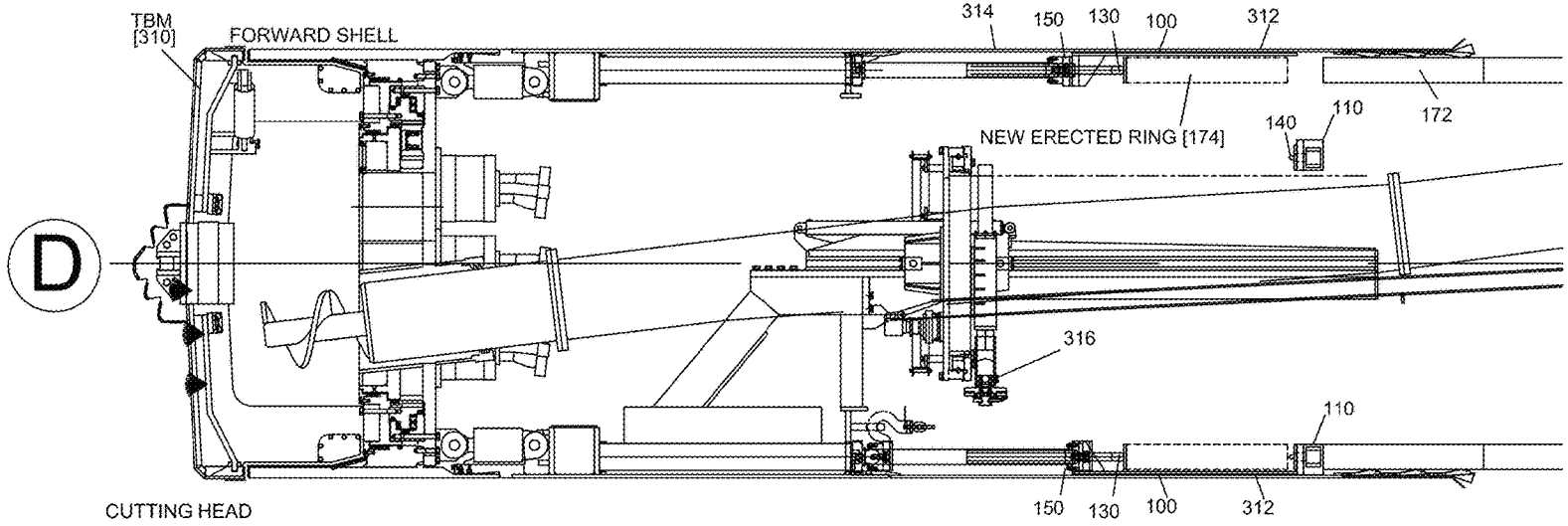
FIG. 8*d*. Stage D FIG. 8*e*. Stage E.
Figure 8E:
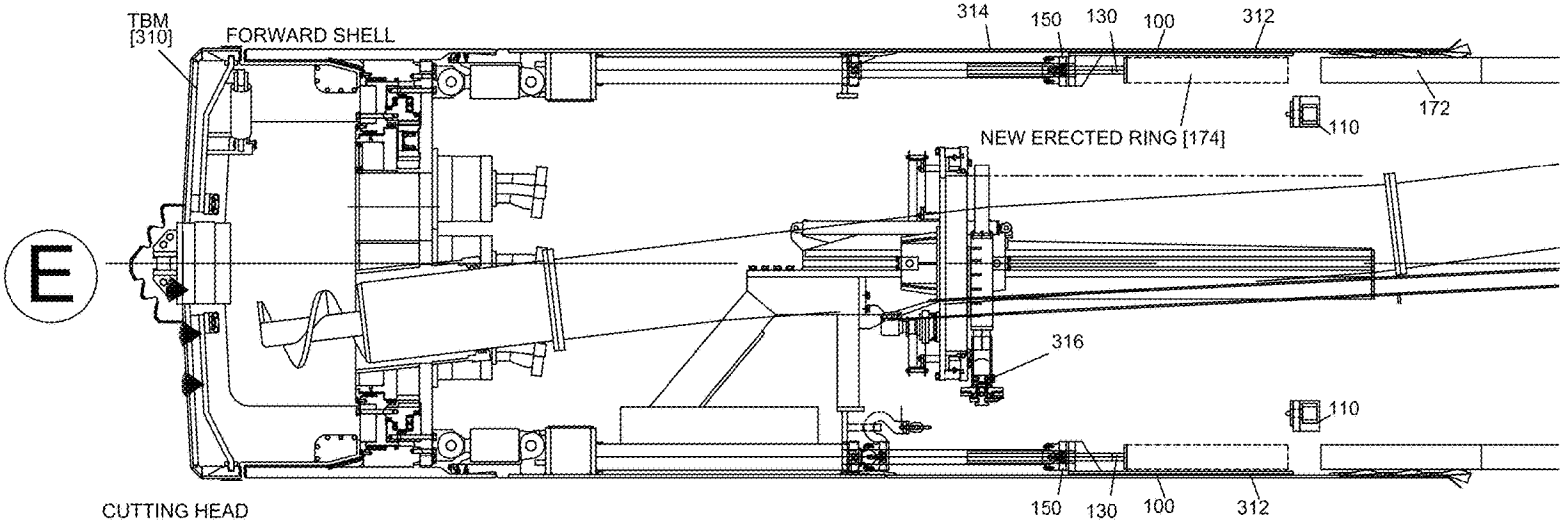
FIG. 8*f*. Stage F.
FIG. 8*g*. Stage G.
FIG. 8*h*. Stage H FIG. 9. Thrust shell and expandable ring without contacting FIG. 10. Thrust shell, expandable ring and segmental ring with contact and interaction
Figure 8F:
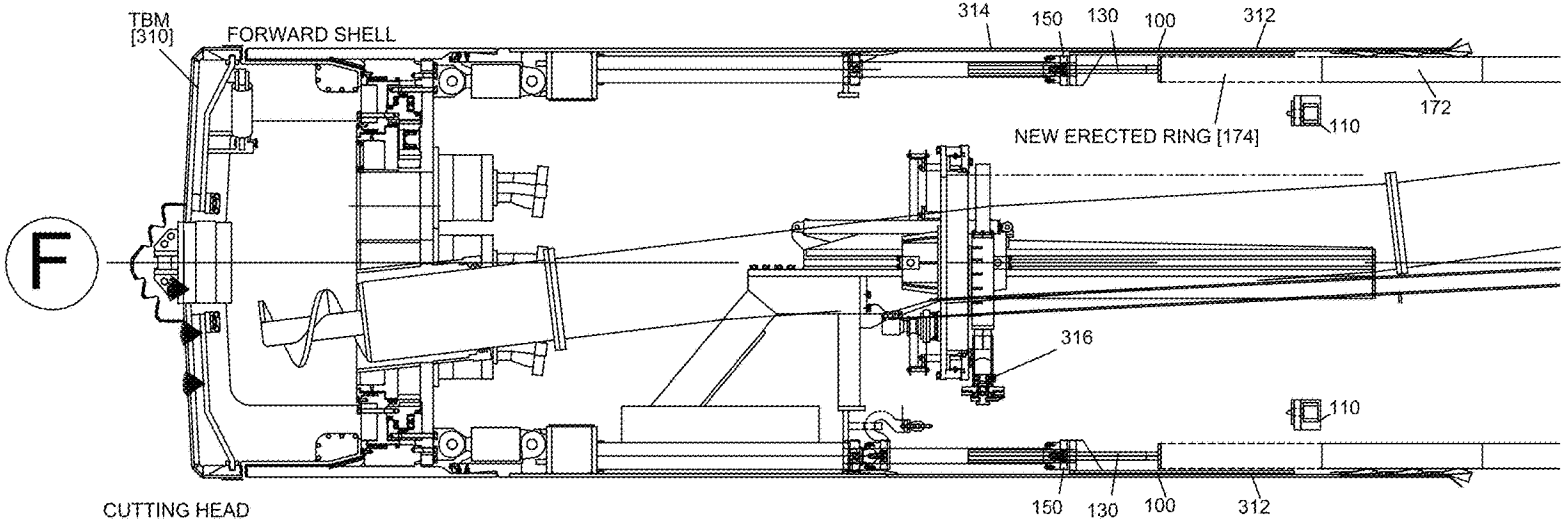
Figure 8G:
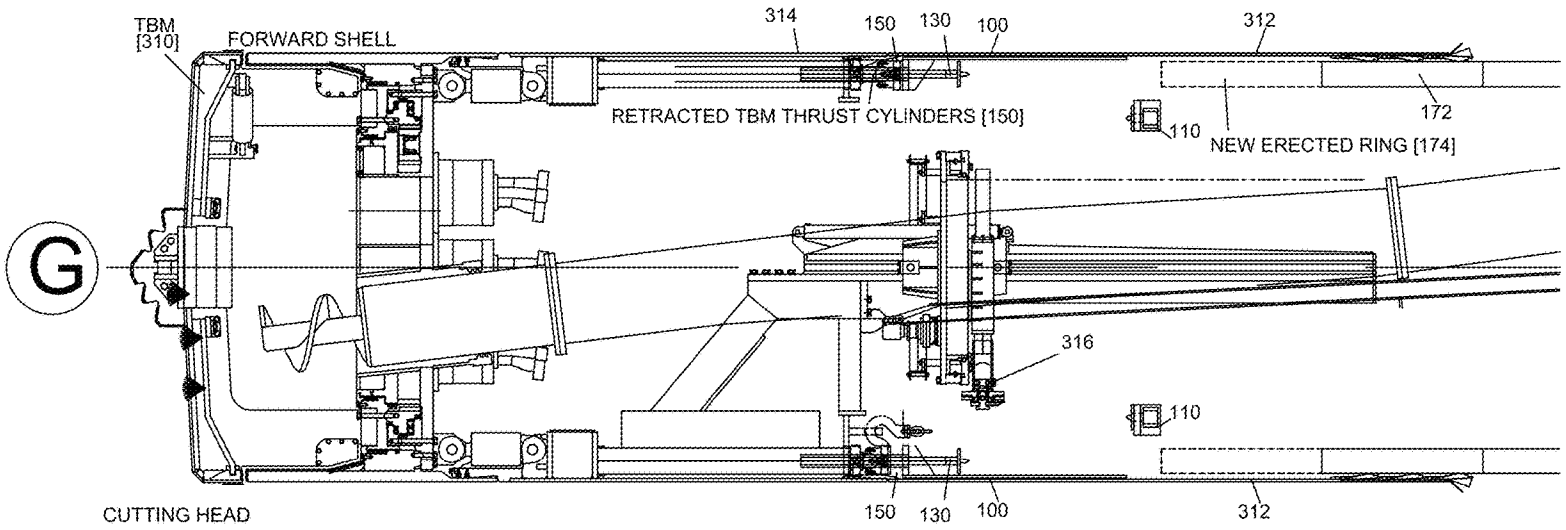

After connection of new and previously installed segmental rings 174 and 172 (e.g. by dowels) and pulling the thrust can 170 out of the newly erected segment ring 174 perimeter, the mentioned segmental ring 174 will be suspended from the previous segmental ring 172 and can be settled lower due to its self-weight (See stage at FIG. 8*g*). There may be couple of ways to avoid settlement of the new segmental ring 174.

As first option, thrust can 170 may be extended permanently at gap 260 locations between sectors 190 of the expandable ring 110 (at least at lowest gap locations), such away that the segmental ring 174 can be still sit on the extension portions of the thrust can 170 even after pulling the thrust can 170 out from around of the latest segmental ring 174. Therefore width of the extended portions of the thrust can 170 would be less than length of the gaps 260 between sectors 190 of the expandable ring 110, and length of them would be couple of feet more than width of the expandable ring 110 to be able to reach to around of the latest segmental ring 174 with sufficient overlap with the segmental ring 174.

The second option would be still pushing and holding the latest segmental ring 174 to the previously erected lining by couple of the axial jacks 130 which have been located at the gaps 260 between sectors of the expandable ring 110. In this case those jacks that will be still contacted to the latest segmental ring 174's leading circumferential side should have long enough stroke for pushing and holding the latest segmental ring 174 even after pulling the thrust can 170 out. Then those jacks can be retracted after positioning of the expandable ring 110 at front of the latest segmental ring and thrust can 170 started pushing the expandable ring 110 which will subsequently hold the latest ring 174.

Alternatively one or plurality of inflatable tube rings may be added to the trailing shield 312 of TBM 310 that would be inflated to temporarily hold the last segmental ring 174 (See stage at FIG. 8*g*) whenever needed. Obviously, combination of above-mentioned options may be utilized as well, if necessary.

After expanding of the expandable ring 110, due to the existence of the gaps 260 between sectors 190 of the expandable ring 110 (see FIGS. 1 and 2), the segmental ring 172 won't be taking TBM 310's thrust push pressure at the gap 260 areas (See FIG. 8*a* stage). This issue may cause tensile (spalling) stresses at the segmental ring 172 at mentioned gap 260 areas and may cause cracks on the segments (assuming made by concrete at this case) if occurred spalling stresses are more than concrete segment's tensile capacity.

Figure 4A:
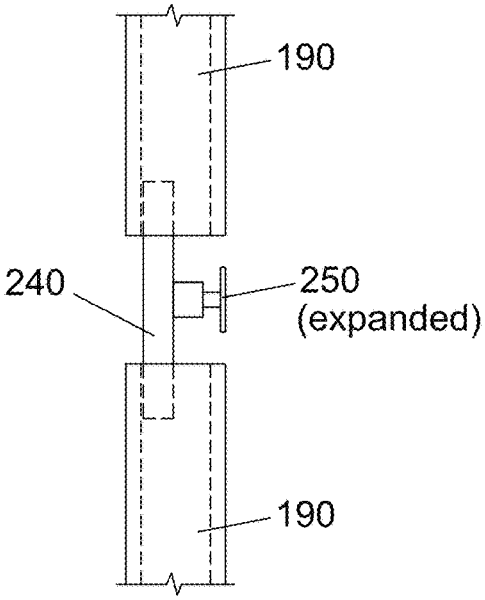
FIG. 4*a*. Option for pushing the segmental ring in the gaps between sectors (expanded ring)
Figure 4B:
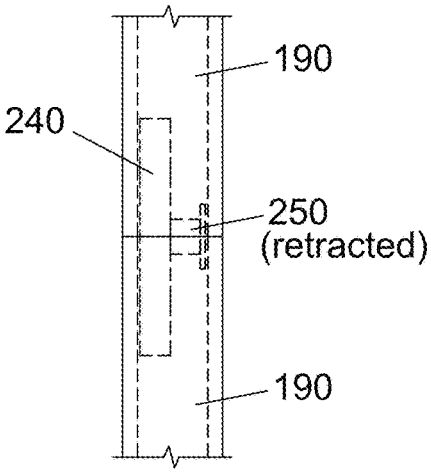
FIG. 4*b*. Option for pushing the segmental ring in the gaps between sectors (collapsed ring)

As a solution for this issue (if necessary), additional telescopic curve beams 240 may be added to inside of the end portion of the sectors 190 of the expandable ring 110 which can move inside the sectors 190 within rails or guidance and will cover the gap 260 between the sectors 190. Each telescopic curve beams 240 will comprise additional axial jack 250 at its middle part that can be extended and contacted with the segmental ring 172 circumferential leading side at gap 260 areas. Therefore, thrust pressure of the TBM 310 will be transferred via the mentioned additional jacks 250 to the segmental ring 172 at gap 260 portions as well. Before collapsing of the expandable ring 110, those jacks 250 on the telescopic beams 240 will be retracted and will be able to entre to inside of the sectors 190 while the expandable ring 110 is collapsing. See FIGS. 4*a* and 4*b* showing mentioned telescopic beam 240 and its mounted axial jack 250 at expanded mode of the expandable ring 110 at FIG. 4*a* and at collapsed mode of the expandable ring 110 at FIG. 4*b*.

If necessary, the thrust shell 100 may be made rotatable within the TBM 310's trailing shield 312. For this case, connection between thrust cylinders 150 of TBM 310 and thrust ring 160 should be detachable (e.g. bolt, interlock, clamp or such connections) and thrust cylinders 150 should be retracted. There are different ways to rotate the thrust shell 100. One simpler option may be using additional circumferential cylinders that can be attached to provisional lugs on the thrust ring 160 from one side which can be engaged with the trailing shield 312 provisional lugs from other side and then by extension or retraction of the mentioned circumferential cylinders, the thrust shell can be rotated.

Packer is recommended to be used on the leading circumferential side of the segmental rings 172/174 that will be in contact with the expandable ring 110. A soft material (wood, stiff rubber or such) also can be attached to the expandable ring 110 surface that will be in contact with the leading side of the segmental ring 172 for better distribution of the thrust pressure.

If necessary, thrust can 170 may be separated from thrust ring 160 as well. In this optional case thrust ring 170 will have contact with the thrust ring 160 surface during TBM 310 pushing and advancing. However, some means of connection will be still necessary between thrust can 170 and thrust ring 160 for pulling out stage of the thrust can 170 from perimeter of the new segmental ring 174. Several options can be considered for such connection. For instance, plurality of angles may be connected (bolted, welded, etc.) on thrust can 170 inner surface edge which can be paired with other angles connected (bolted, welded, etc.) on inner surface edge of the thrust ring 160 and then mentioned paired angles can have detachable connection (bolted, clamped, interlocked, etc.) together.

By detachable thrust ring 160 from the thrust can 170, thrust can 170 can be made rotatable within TBM 310's trailing shield 312 with almost similar way explained previously. For instance additional circumferential cylinders can be attached to provisional lugs on the thrust ring 160 from one side which can be engaged with the provisional lugs of the Can 170 from other side and then by extension or retraction of the mentioned circumferential cylinders between mentioned provisional lugs, the Can 170 can be rotated.

Figure 5:
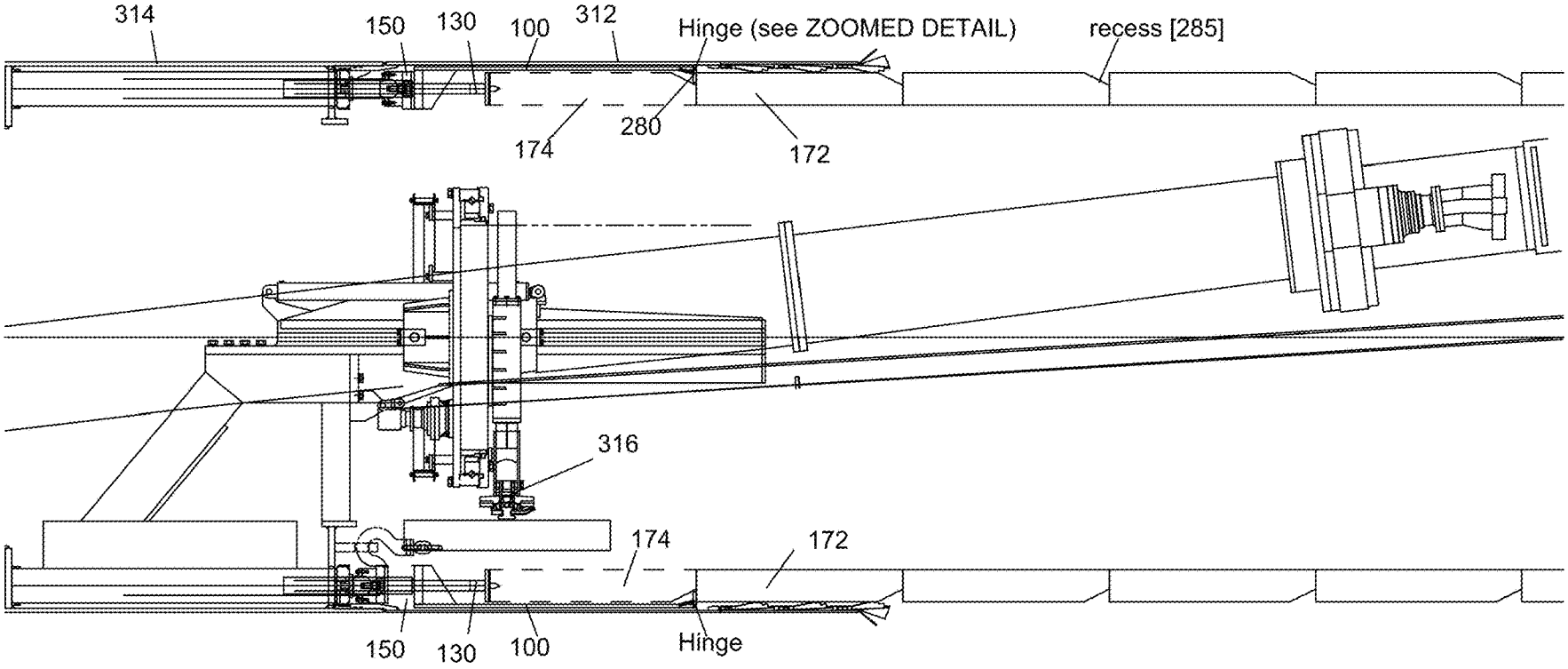
FIG. 5. Modified segment example to avoid using any expandable ring

An alternative way to avoid using any Expandable ring 110 at the simultaneous tunnelling method by thrust shell system is that the precast segments may be modified in such a way that their outer perimeter trailing circumferential side has recess 285 to accommodate a circumferential plate 280 on the thrust can 170 to push on the segment as shown at FIG. 5.

At this alternative, plurality of circumferential plates 280 will be connected to the Thrust shell's Can 170 by strong Hinges 270. At the recess 285 areas of the segments, the mounted springs 290 on the Can 170 will retract the circ. plates 280 to the perpendicular position to the Can 170 by help of the Stoppers 300 at the edge of the Can 170 and so the Can 170 can push against the previously installed segmental ring 172. After completion of the pushing cycle for one ring and after completion of installation of the new segmental lining 174 within the Can 170, The Can 170 will be pulled back and circ. plates 280 will be rotated while contacting with the recess 285's sloped area and may move along the Can 170 within gap between TBM 310's trailing shield 312 and newly installed segmental lining 174.

Figure 5A:
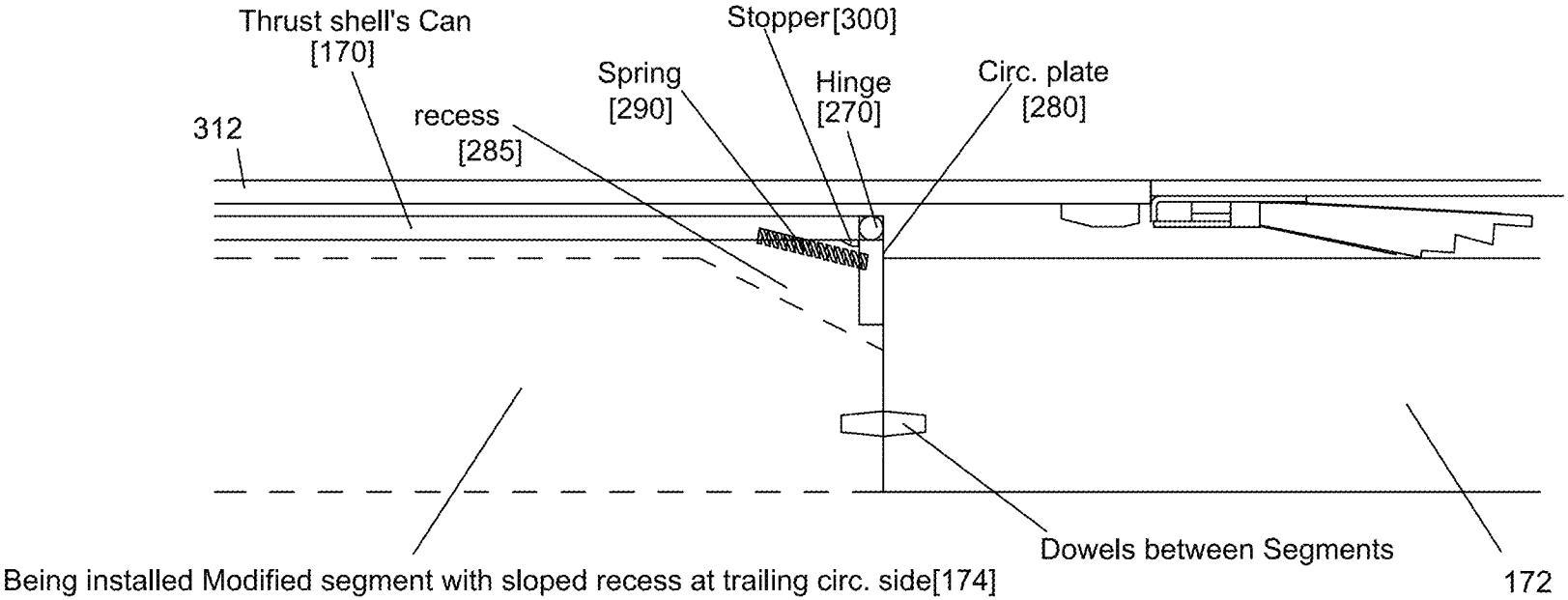
FIG. 5*a*. Zommed detail of the hinged circumferential plates

In other words, in this case the thrust can 170 of the thrust shell 100 will have plurality of segmented circumferential plates 280 at its end that are connected to the Can 170 by strong hinges 270 and will be able to rotate and contact with the previously installed segmental lining to push TBM 310 forward. The hinged circ. plates 280 will have springs 290 and stopper 300, as shown at FIG. 5 and zoomed details at FIG. 5*a*, that will hold the plate at vertical position unless thrust can 170 will be pulled toward the TBM 310's mining direction which at this condition, the springs 290 will be extended and thus circumferential plates 280 will be almost at horizontal position and will be able to pass within gap between segmental ring 174 and trailing shield 312. Tiny hydraulic cylinders/jack may be used instead of springs 290 at this case. The recess 285 areas of the segments will be filled by TBM 310's lining grouting automatically. The hinge 270 may have a design that would be able to control and stop the plates 280 at their vertical position without any need for the stoppers 300.

As an option, an attached inflatable ring may be utilized instead of circ. plate 280 (without stopper 300 or springs 290) which will be inflated during TBM 310 thrusting and deflated TBM 310 re-gripping (during retraction of thrust cylinders 150 and pulling thrust shell 100)

In many of the projects, the TBM 310 face pressure would be less than friction resistance created between TBM 310 shields and soil around it and therefore most likely the TBM 310 is not expected to be able to move backward at the moment of releasing the Expandable ring 110 at the proposed thrust shell 100 system (See stage at FIG. 8*e*). Note that the TBM 310 should be prolonged to enable attaching the thrust shell 100 system, within its trail shield around 1.5 times of segment width (e.g. 2.25 m longer for 1.5 m width segments) which will help increasing friction resistance force too. In addition TBMs 310 usually have heavy-weight and thus friction resistance generated at bottom side of TBM 310 can be added to the friction estimation calculations as well . . . .

Further, the support pressure at chamber behind the cutterhead of EPB or Slurry TBM 310 to counter balance the face pressure might be taken into account as resistance force with consideration of securing the TBM 310's gantry (which hydraulic pressure generator has been mounted) within previously built lining and thus making the mentioned support pressure as an external force against the face pressure.

Figure 6:
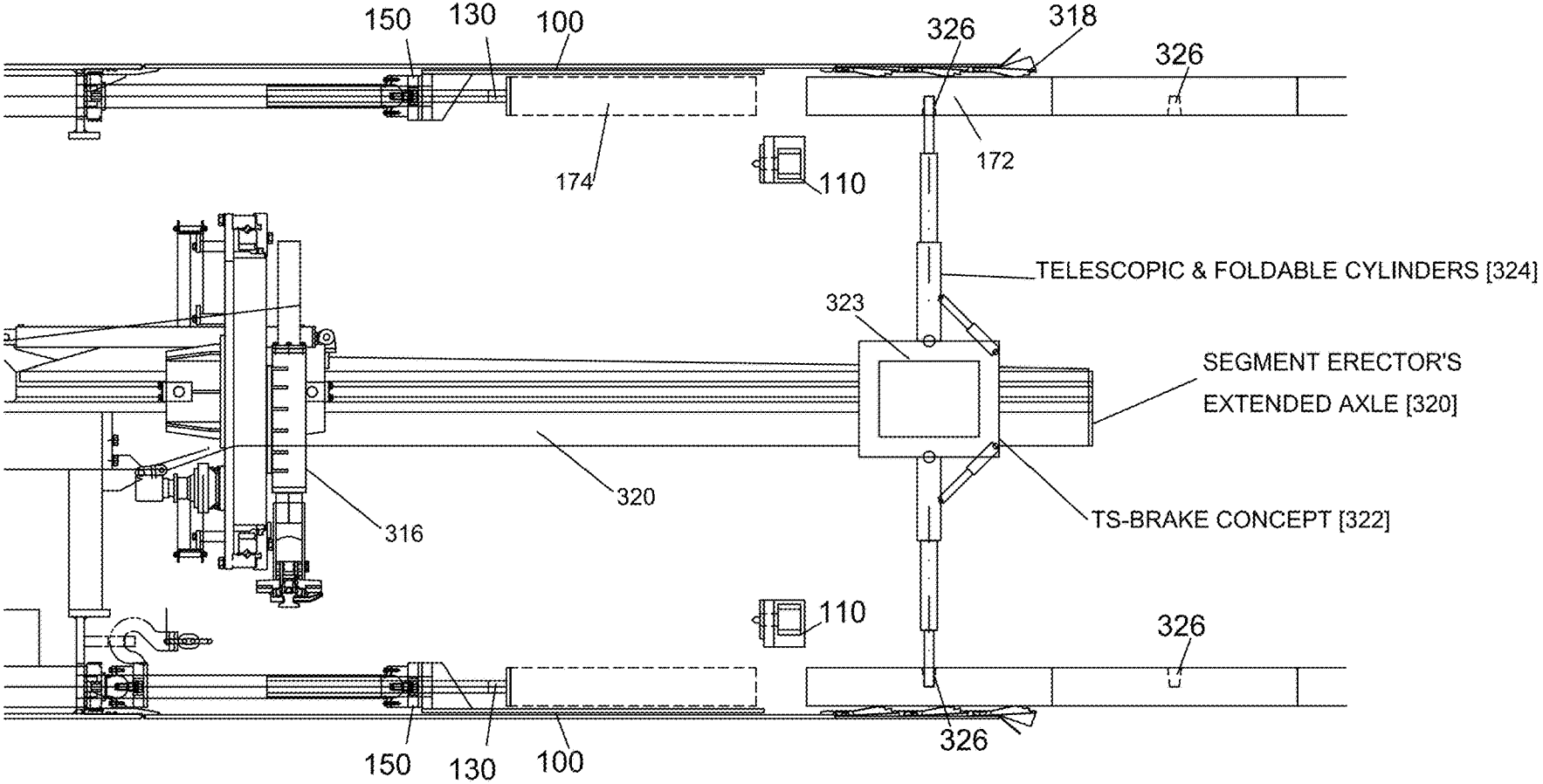
FIG. 6. TS-brake general concept

If in some of the specific projects the friction resistance along with the support pressure is not sufficient to counter balance the face pressure of the TBM 310, then below three methods/systems (a, b or c) may be considered to prevent TBM 310 moving backward at the moment of releasing the expandable ring 110 (see stage at FIG. 8*e*):

a) Using "Plough" system; Similar to older TBM 310*s*, behind the cutterhead chamber couple of angled ploughs may be added which can be entered into the soil by their hydraulic rams just before releasing the expandable ring 110 which can prevent the TBM 310 moving backward. Then as soon as re-gripping completed at the thrust shell 100 system, the plough will be moved to their original position.

b) Using "stabilizer"; The Stabilizer are used at newer TBM 310*s* which similarly can be used in proper sizes and nos. to hold the TBM 310 at soft soil against backward movement whenever necessary.

c) Utilizing of the new Brake system called Thrust Shell-Brake (TS-brake 322). At the end portion of the existing axle 320 of segment erector 316 (i.e. end portion of the existing fixed Frame/axle 320 of the segment erector 316), a mobile ring 323 will be mounted which is able to rotate or move backward/forward or be locked on the mentioned axle/frame 320 (i.e. a separate mobile ring 323 on the existing axle 320 that is movable similar to segment erector 316 design). The mobile ring 323 will have couple of telescopic and foldable cylinders/rods 324 (let's say 4 locations with almost equal distances around the mobile ring 323) to reduce their occupied space and obstruction which can be extended and entered into the concrete segment's existing lifting sockets 326 within the already installed segmental ring 172. Then it can be locked and work as brake to prevent TBM 310 moving backward (and forward). If necessary, the fixed frame/axle 320 of the segment erector 316 may be slightly prolonged to accommodate the explained TS-Brake 322 system. See a TS-Brake concept at FIG. 6.

The TS-brake can have different variations, for instance the telescopic rods 324 may be foldable to minimize their space while they are retracted. Also shoe plates may be added on the telescopic cylinders 324 that will touch and push to inner surface of the ring 172 without necessity to enter inside the lifting sockets 326.

The new segmental Ring 174 and Thrust shell 100 and TBM's trailing shield 312 may be always parallel (even at curves), to prevent getting them stuck/jammed.

Figure 7:
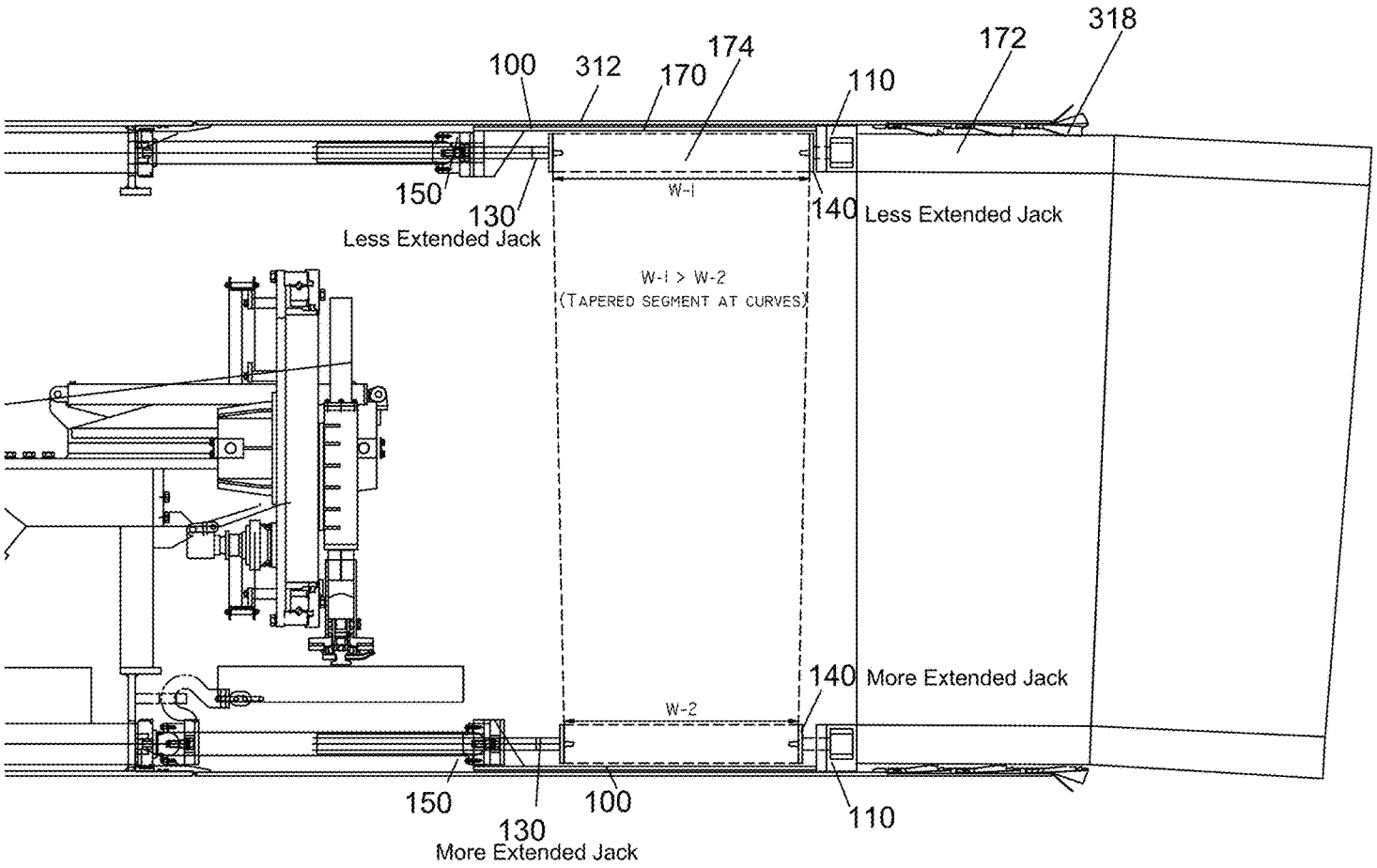
FIG. 7. Thrust shell system at curve alignment

As shown at FIG. 7, at an exaggerated very sharp curve new segmental ring 174 which is being erected within the Thrust Shell's Can 170 is kept parallel to the Can 170 by adjusting and simply less extension of jacks 130 and 140 at one side and more extension at other side for the tapered segmental ring 174 which has more width at one side and less width at other side in order to provide curve alignment at the lining.

So always expandable ring 110 and Thrust shell Can 170 will be contacting to the previously installed Ring 172 properly, even at curves, for appropriately pushing against the previously installed segmental ring 172.

The rest of the concept at curve is very similar to the Conventional/Typical tunneling by TBMs. For example previously installed segmental ring 172 at the curved alignment will be located within TBM's brush 318 area and TBM's trailing shield 312 will be passing the curves in similar way of the conventional TBMs.

The thrust shell 100 system can be used at different tunnel cross sections e.g. circle, oval, square, rectangular, sub-rectangular and such. Regardless of any tunnel section shape, it would be necessary that Thrust shell 100 to follow tunnel cross section shape and be able to move backward or forward between trailing shield 312 of TBM 310 and Segmental lining 172/174.

Stages Summary:

FIGS. 8*a* and 8*b* illustrate stages A and B as following:

Stage-A: Ready to install Segments within Thrust Shell 100 and ready to push TBM 310 forward against previously installed ring 172.

Stage-B: Segments of new Ring 174 are being installed by Segment Erector 316 (between jacks 130 mounted on Thrust Shell 100 and jacks 140 mounted on Expandable ring 110), while TBM thrust cylinders 150 are pushing and advancing against previously installed ring via thrust shell 100 and via expandable ring 110 located front of the previously installed ring.

FIGS. 8*c* and 8*d* illustrate stages C and D as following:

Stage-C: TBM 310 is moved forward equal to width of the ring.

A ring has been completed by segment erector within thrust shell 100, while TBM was advancing forward.

Stage-D: The mounted jacks 140 on the expandable ring 110 are being retracted and then expandable ring 110 is being collapsed.

FIGS. 8*e* and 8*f* illustrate stage E and F as following:

Stage-E: The collapsed expandable ring 110 will be lifted by Segment erector 316 to clear space between previously 172 and newly installed rings 174.

Stage-F: The newly erected ring 174 is being pushed by jacks 130 mounted on the Thrust-shell 100 toward its final position contacting with the previously installed ring 172.

Figure 8H:
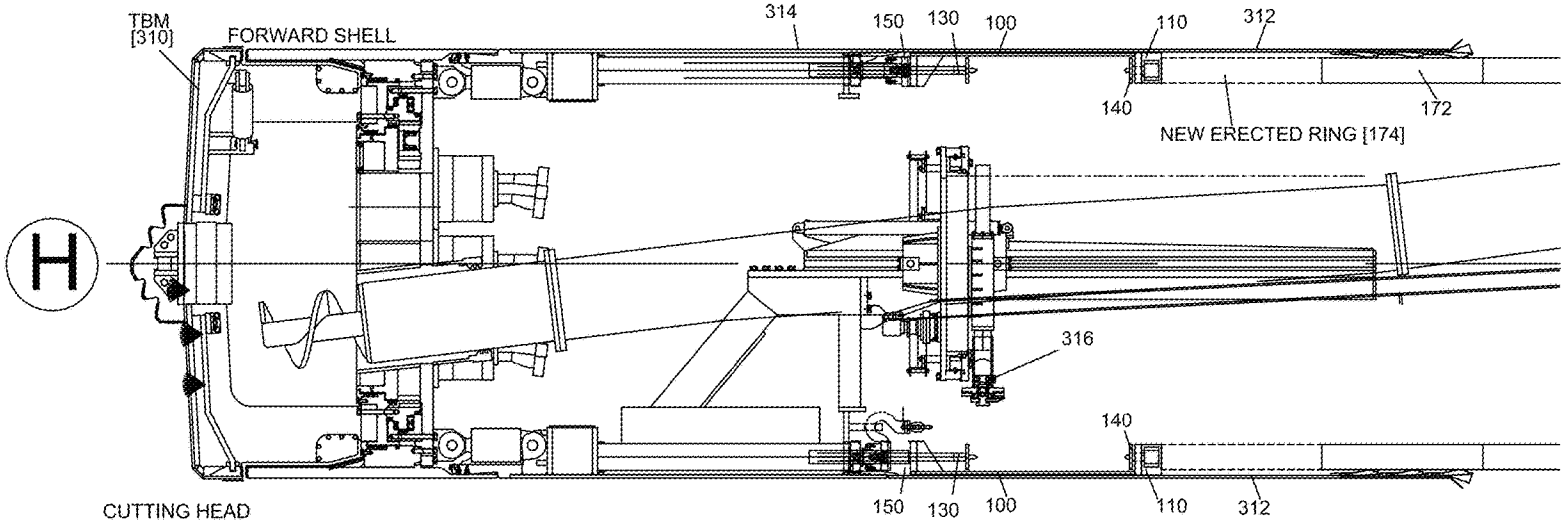

FIGS. 8*g* and 8*h* illustrate stage G and H as following:

Stage-G: In the meantime Thrust shell 100 is pulled by TBM 310's thrust cylinders 150 and expandable Ring 110 is pulled by Segment Erector 316 to its new position at leading side of the new erected segmental ring 174.

Stage-H: The Expandable ring 110 is being expanded and positioned in front of the installed ring 174 and Thrust Shell 100 is being pushed to be contacted with the Expandable Ring 110 The mounted jacks 140 on the Expandable ring 110 are being expanded as well.

Stages: "A~H" to be repeated for the next cycles.

Figure 9:
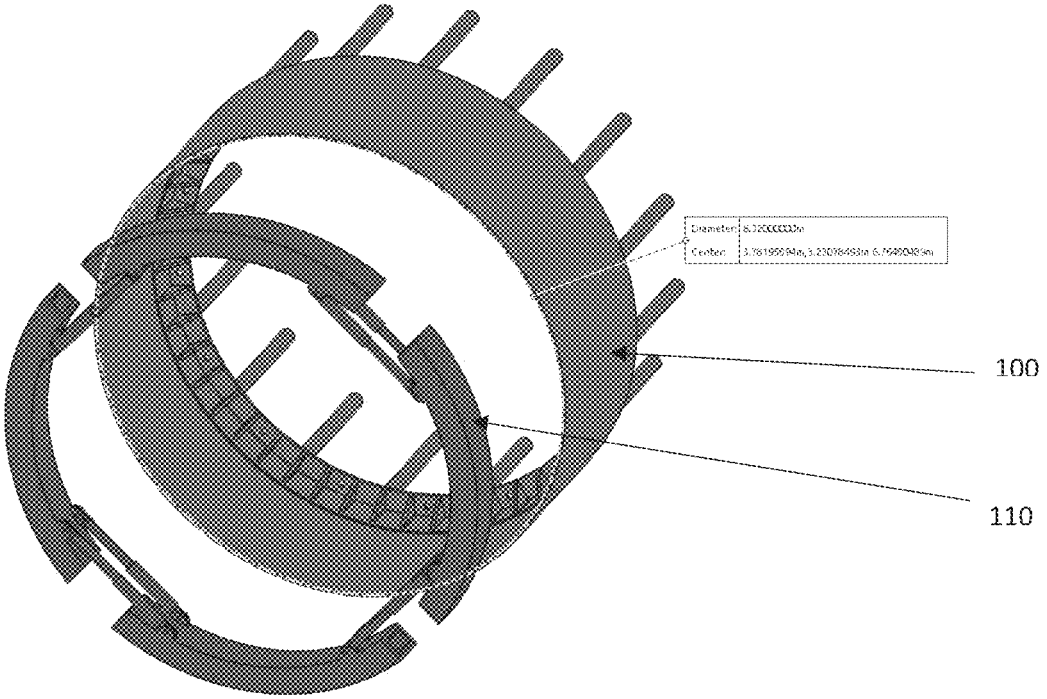
Figure 10:
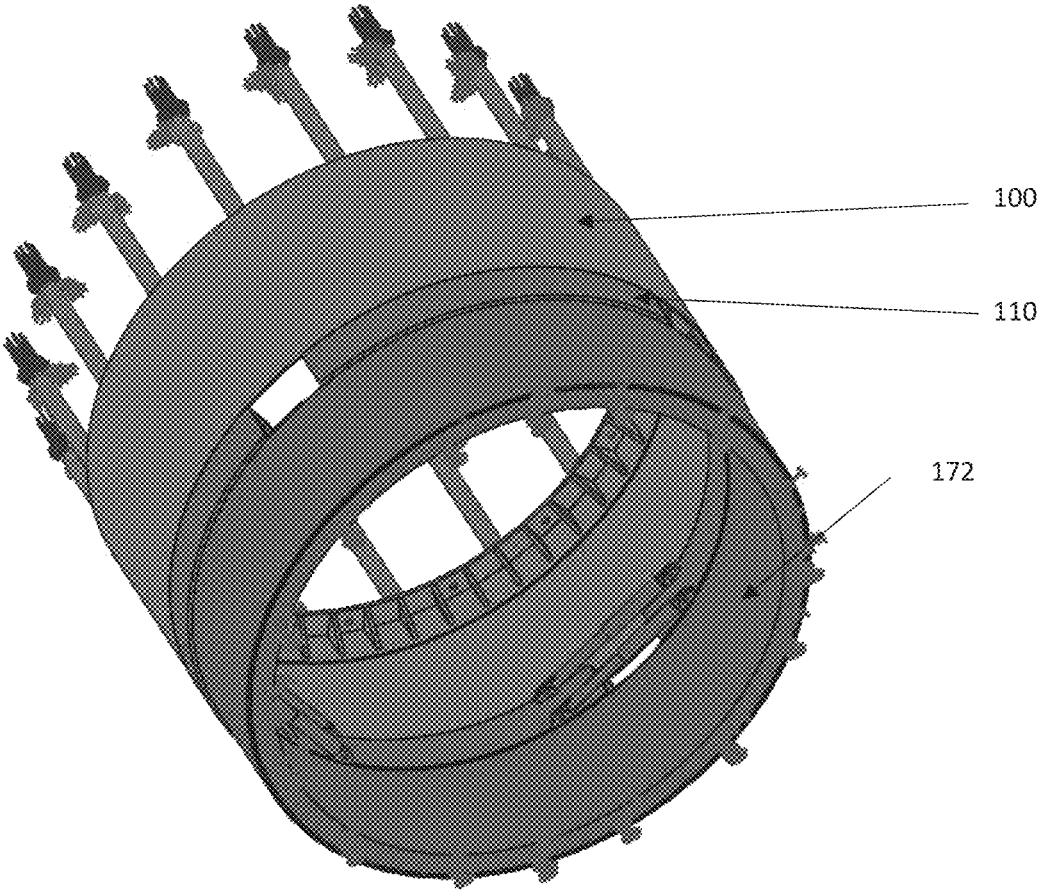

Extra example of the thrust shell 100 system has been shown at FIGS. 9, 10.

The axial jacks 130 and 140 have not been shown for more clarity. Also previously installed segmental ring 172 at FIG. 10 has been shown as a simple ring (without lines showing boarders of the segments) to provide a simpler image.

FIG. 9 is showing thrust shell 100 and expandable ring 110 at a stage without contacting.

FIG. 10 is showing thrust shell 100, expandable ring 110 and previously installed segmental lining 172 at a stage with contact and interaction at a 3d Finite Element Model (FEM).

ELEMENTS LIST

100 Thrust shell
110 Expandable Ring
120 Circumferential cylinders/jacks
130 Axial mounted Jack of 100
140 Axial mounted Jack of 110
150 TBM's Thrust cylinder
160 Thrust ring of 100
170 Hollow can of 100
172 Previously installed segmental Ring
174 New installed (Being installed) Segmental Ring
180 Stiffener of 160
190 Sectors of 110
200 struts on the Jack shoes
210 lowest sector of 110
220 upper sector of 110
230 inner strip roller
235 outer strip roller
240 Telescopic beam
250 Axial jack on 240
260 Gap between sectors of 110
270 Hinge
280 Circumferential plate
285 Recess of segment
290 Spring
300 Stopper
310 Tunnel Boring Machine (TBM)

-continued

312 Trailing Shield of TBM
314 Stationary shield of TBM
316 Segment Erector of TBM
318 Brushes of TBM
320 Axle (Frame) of 316
322 TS-Brake concept
323 Mobile ring of 322
324 Telescopic cylinders (rods) 322
326 Lifting socket of segments

What is claimed is:

1. A thrust shell system for use in tunnel segmental lining by a TBM, the system comprising:

a thrust can that moves within a gap between a trailing shield of said TBM and a new segmental ring, a thrust ring which has connections with said thrust can from one side and thrust cylinders of said TBM from another side, an expandable ring that is used between said thrust can and a previously erected segmental ring to transfer the thrust force of said thrust cylinders to said previously erected segmental lining, wherein during an expanded mode of said expandable ring the outer diameter of said expandable ring is equal to the outer diameter of said thrust can to be able to contact with said thrust can, and wherein during a collapse mode of said expandable ring, an outer diameter of said expandable ring is less than an inner diameter of said new segmental ring to be able to move within said new segmental ring.

2. The thrust shell system according to claim 1, further comprising a plurality of mounted axial jacks or cylinders on said thrust ring of said TBM to be used for erection of said new segmental ring within said thrust can.

3. The thrust shell system according to claim 1, further comprising a plurality of mounted axial jacks or cylinders on said expandable ring to be used for erection of said new segmental ring within said thrust can.

4. The thrust shell system according to claim 1, wherein said expandable ring further comprises a plurality of sectors that are connected by a plurality of circumferential jacks or cylinders that are used for expanding or collapsing of said expandable ring.

5. The thrust shell system according to claim 1, wherein said expandable ring further comprises a plurality of telescopic beams with an additional mounted axial jacks or cylinders on them within said expandable ring that will cover a gaps between said sectors in order to transfer thrust force of said TBM to said previously erected segmental ring at said gaps.

6. The thrust shell system according to claim 1, wherein a plurality of single or strip rollers are connected at said thrust can to ease forward and backward movement of said new segmental ring on said thrust can and ease forward and backward movement of said thrust can on said trailing shield of said TBM.

7. The thrust shell system according to claim 1, further comprising a TS-brake system for use in tunnel segmental lining to prevent the TBM to move backward and forward, said TS-brake system comprising:

a mobile ring which is able to move backward and forward and rotate on a axle of a segment erector of said TBM, and a plurality of telescopic rods that are mounted on said mobile ring that can be extended to enter lifting sockets of said previously erected segmental ring.

8. The TS-brake system according to claim 7, wherein said telescopic rods are foldable to reduce their obstruction and occupied space.

9. A thrust shell system for use in tunnel segmental lining by a TBM, the system comprising:

a thrust can that moves within a gap between a trailing shield of said TBM and a new segmental ring, a thrust ring which has connections with a thrust can from one side and said thrust cylinders of said TBM from another side, wherein a plurality of circumferential plates connected to said thrust can by a plurality of hinges that are able to change position from horizontal to vertical by a plurality of springs that are connected to said circumferential plates from one side and said thrust can from another side, wherein said circumferential plates will be at a vertical position at a location of a previously erected segmental ring that have recesses at their outer perimeter of a trailing circumferential side to accommodate said plates at vertical position and provide space for said circumferential plates to transfer thrust load from said thrust can to said previously erected segmental lining, and wherein said circumferential plates will be at horizontal position while pulled back by said thrust can and rotating around said hinge while contacting with a slope portion of the recesses.

* * * * *